US011433508B2

(12) United States Patent
Tsai

(10) Patent No.: US 11,433,508 B2
(45) Date of Patent: Sep. 6, 2022

(54) JOINT-DISCONNECTING TOOL

(71) Applicant: Chien Yu Hong Co., Ltd., Taichung (TW)

(72) Inventor: Chang-Ta Tsai, Taichung (TW)

(73) Assignee: Chien Yu Hong Co., Ltd., Taichung (TW)

( * ) Notice: Subject to any disclaimer, the term of this patent is extended or adjusted under 35 U.S.C. 154(b) by 205 days.

(21) Appl. No.: 16/894,981

(22) Filed: Jun. 8, 2020

(65) Prior Publication Data

US 2021/0245333 A1 Aug. 12, 2021

(30) Foreign Application Priority Data

Feb. 12, 2020 (TW) ..... 109201516

(51) Int. Cl.

| | |
|---|---|
| ***B25B 7/12*** | (2006.01) |
| ***B25B 7/08*** | (2006.01) |
| ***B25B 25/00*** | (2006.01) |
| ***B25B 27/10*** | (2006.01) |
| ***B25B 9/00*** | (2006.01) |
| *B25B 27/00* | (2006.01) |

(52) U.S. Cl.

CPC ..... *B25B 7/12* (2013.01); *B25B 7/08* (2013.01); *B25B 9/00* (2013.01); *B25B 25/005* (2013.01); *B25B 27/10* (2013.01); *B25B 27/0035* (2013.01)

(58) Field of Classification Search

CPC .... B25B 7/02; B25B 7/04; B25B 7/06; B25B 7/08; B25B 7/12; B25B 7/18; B25B 7/22; B25B 9/00; B25B 9/04; B25B 25/00; B25B 25/005; B25B 27/02; B25B 27/10; B25B 27/0035; B25B 27/22

See application file for complete search history.

(56) References Cited

U.S. PATENT DOCUMENTS

| | | | | |
|---|---|---|---|---|
| 5,582,084 | A * | 12/1996 | Sarmiento | B25B 7/00 81/383 |
| 10,632,598 | B2 | 4/2020 | Wu | |
| 2018/0236643 | A1 * | 8/2018 | Wu | B25B 27/0035 |

* cited by examiner

*Primary Examiner* — Robert J Scruggs

(74) *Attorney, Agent, or Firm* — Alan D. Kamrath; Karin L. Williams; Mayer & Williams PC

(57) ABSTRACT

A joint-disconnecting tool includes a clamp and a controller. The clamp includes a case, two branches, a pin and two linking elements. Each of the branches includes a lever extending in the case and a jaw extending out of the case. The pin connects the levers to the case. Each of the linking elements includes an end pivotally connected to one of the levers in the case. The controller includes two handles, a wire, a sheath and a spring. The handles are pivotally connected to each other. The wire includes an end connected to one of the handles and another end connected to another end of each of the linking elements. The sheath wraps the wire except for the ends. The sheath includes an end abutted against another one of the handles and another end abutted against the case. The spring tends to push the linking elements from the case.

5 Claims, 7 Drawing Sheets

JOINT-DISCONNECTING TOOL

BACKGROUND OF INVENTION

1. Field of Invention

The present invention relates to a hand tool and, more particularly, to a joint-disconnecting tool.

2. Related Prior Art

A joint is used to connect a pipe to another pipe. In a vehicle such as a car where space is limited, a special joint is preferred. Hence, a special tool is preferred to disconnect such a special joint.

For example, Taiwanese Patent No. 1611877 discloses a special tool 3 for disconnecting a special joint 1 that connect a pipe 91 to another pipe 92. The joint 1 includes an insert 11, a ring 12 and a cage 13. Both the insert 11 and the cage 13 are tubular elements. The ring 12 is inserted in an annular groove in an external face of a section of the pipe 91 before the section of the pipe 91 is inserted in the insert 11. The cage 13 includes a reduced section 131 for receiving a section of the pipe 92. The insert 11 includes two elastic barbs 112. The cage 13 includes two openings 132 for receiving the elastic bars 112 when the cage 13 receives the insert 11. Thus, the pipe 91 is connected to the pipe 92.

The tool 3 is used to press the elastic barbs 112 toward each other and hence move the elastic barbs 112 from the openings 132. Thus, the insert 11 can be disconnected from the cage 13. The tool 3 includes a case 41, two jaws 43 and a spring 44. Each jaw 43 includes two lugs 431 near a rear end and a contact portion 435 near a front end. The lugs 431 of one jaw 43 are pivotally connected to the lugs 431 of the other jaw 43. The spring 44 is compressed between the jaws 43. The lugs 431 of the jaws 43 are moved deeper into the case 41 to move the contact portions 435 of the jaws 43 toward each other. However, the use of the tool 3 is not without any problems. For example, it is difficult to precisely bring the contact portions 435 of the jaws 43 into contact with the elastic barbs 112 of the insert 11 of the joint 1 because the contact portions 435 of the jaws 43 are moved toward each other as the jaws 43 are moved deeper into the case 41.

Moreover, it is more difficult to precisely bring the contact portions 435 of the jaws 43 into contact with the elastic barbs 112 of the insert 11 of the joint 1 when the joint 1 and the jaws 43 are not visible such as in an engine compartment of a car.

Furthermore, an external face of each jaw 43 rub against an internal face of the case 41. Thus, the jaws 43 wear against the case 41. In addition, the rubbing imposes difficulty on operating the tool 3.

The present invention is therefore intended to obviate or at least alleviate the problems encountered in the prior art.

SUMMARY OF INVENTION

It is the primary objective of the present invention to provide a joint-disconnecting tool.

To achieve the foregoing objective, the joint-disconnecting tool includes a clamp and a controller. The clamp includes a case, two branches, a pin and two linking elements. Each of the branches includes a lever substantially extending in the case and a jaw extending out of the case. The pin pivotally connects the levers to the case. The pin is not movable relative to the case. Each of the linking elements includes an end pivotally connected to one of the levers in the case. The controller includes two handles, a wire, a sheath and a spring. The handles are pivotally connected to each other. The wire includes an end connected to one of the handles and another end connected to another end of each of the linking elements. The sheath wraps the wire except for the ends. The sheath includes an end abutted against another one of the handles and another end abutted against the case. The spring tends to push the linking elements from an internal portion of the case.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
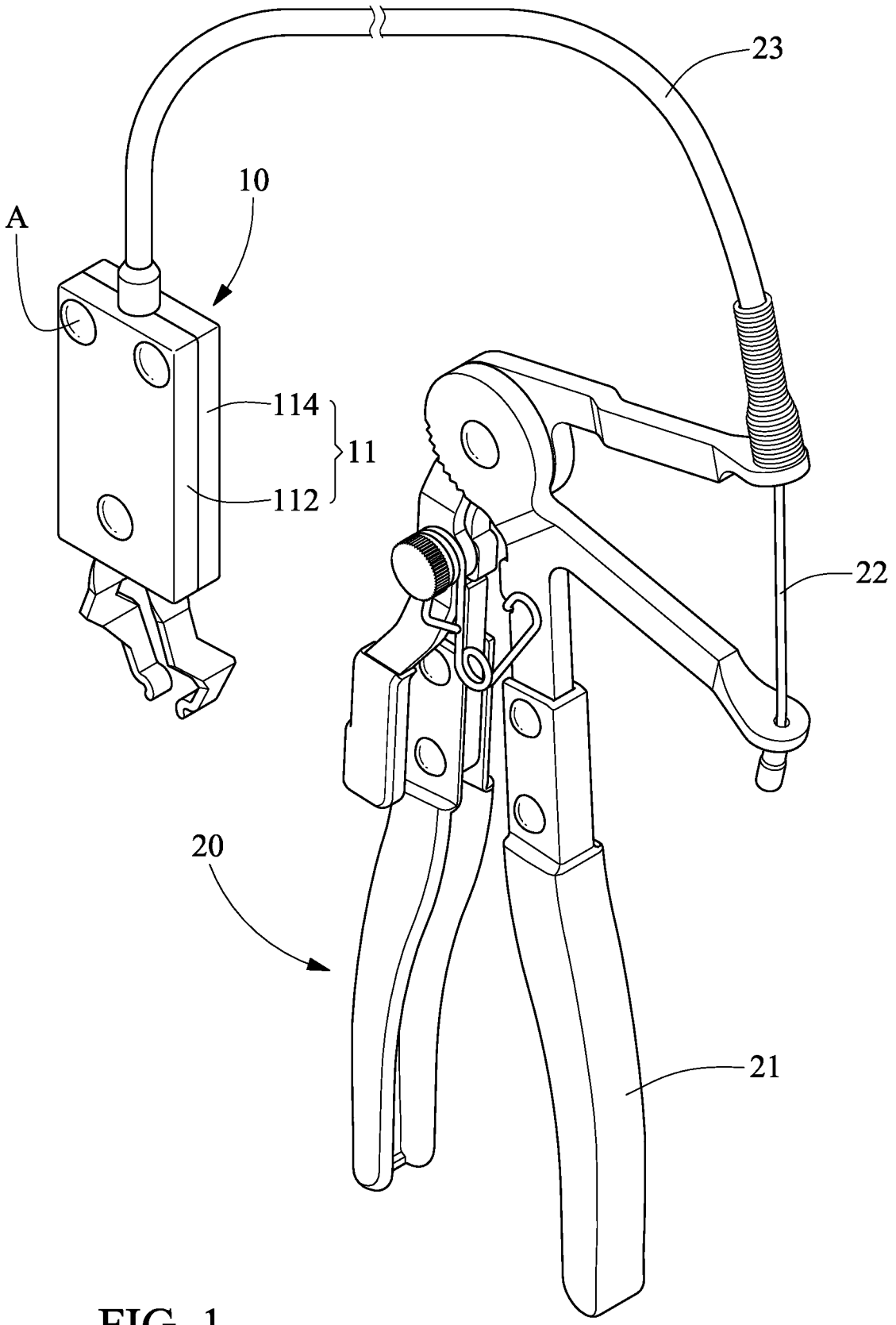
FIG. 1 is a perspective view of a joint-disconnecting tool according to the preferred embodiment of the present invention.

Referring to FIGS. 1 through 6, a joint-disconnecting tool includes a clamp 10 and a controller 20 in accordance with the preferred embodiment of the present invention. The controller 20 is operable to close the clamp 10.

The clamp 10 includes a case 11, a first branch 12, a second branch 13, a first linking element 14 and a second linking element 15.

Figure 2:
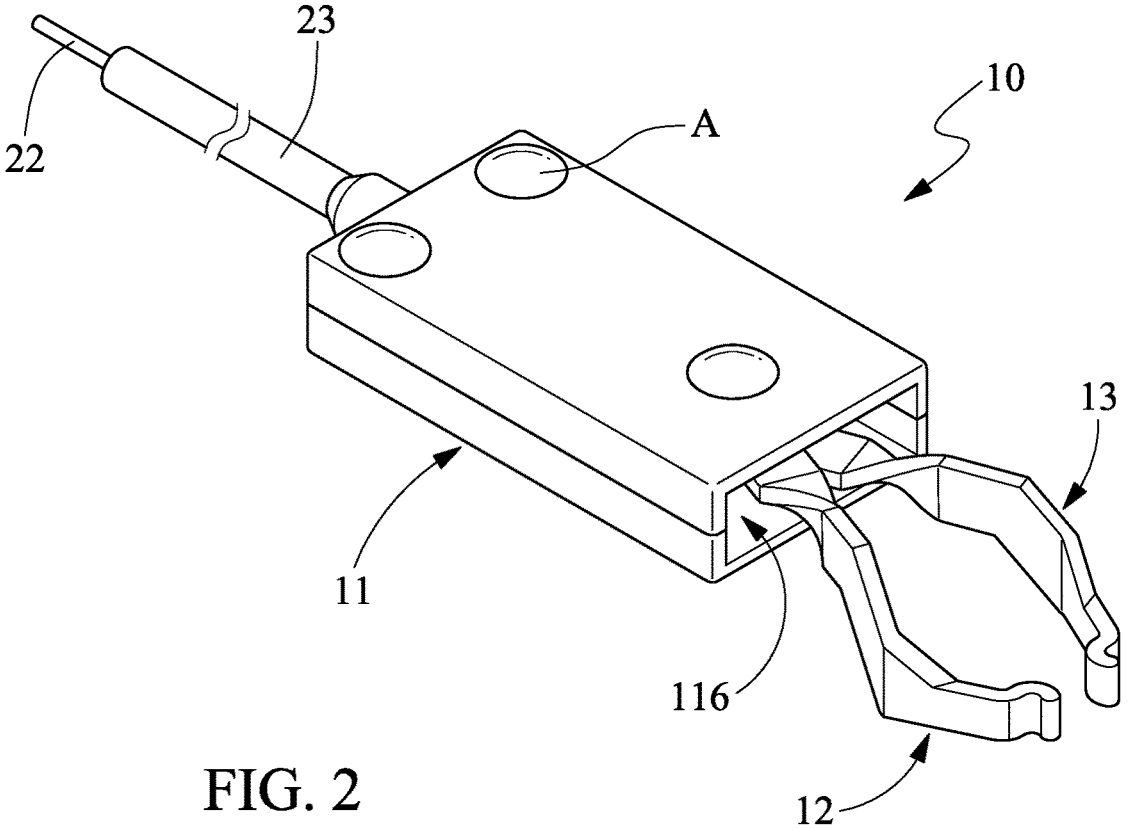
FIG. 2 is a perspective view of a clamp of the joint-disconnecting tool shown in FIG. 1.
Figure 3:
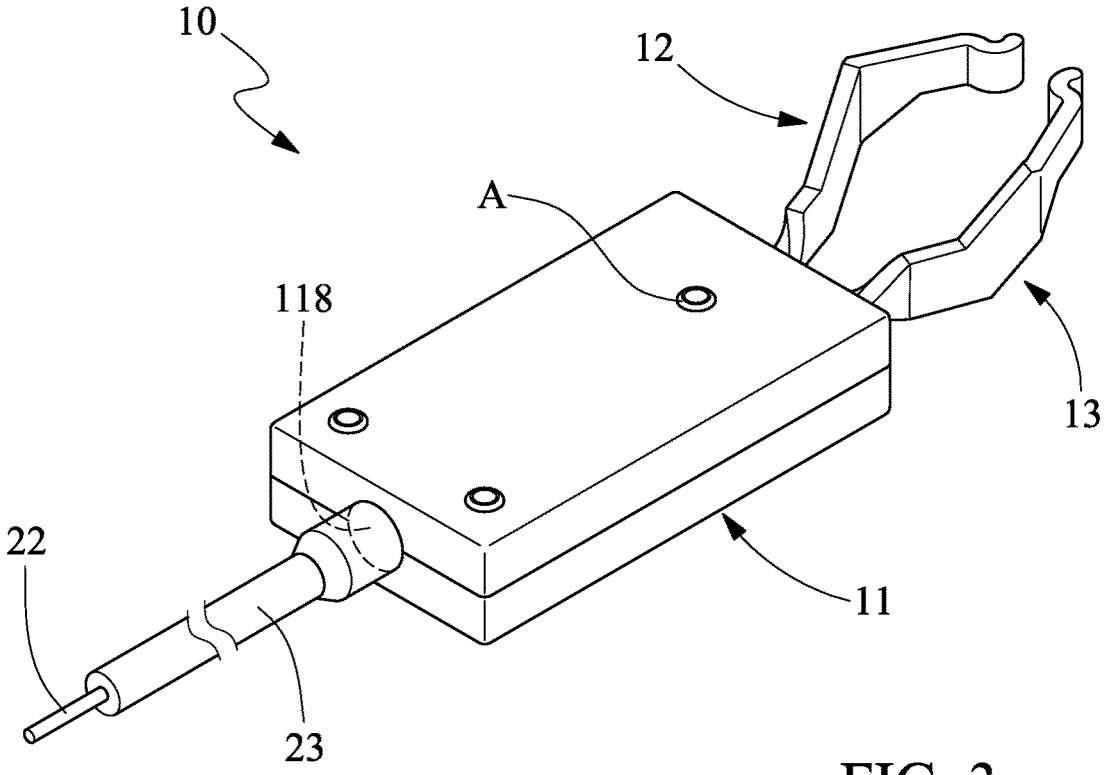
FIG. 3 is another perspective view of the clamp shown in FIG. 2.
Figure 4:
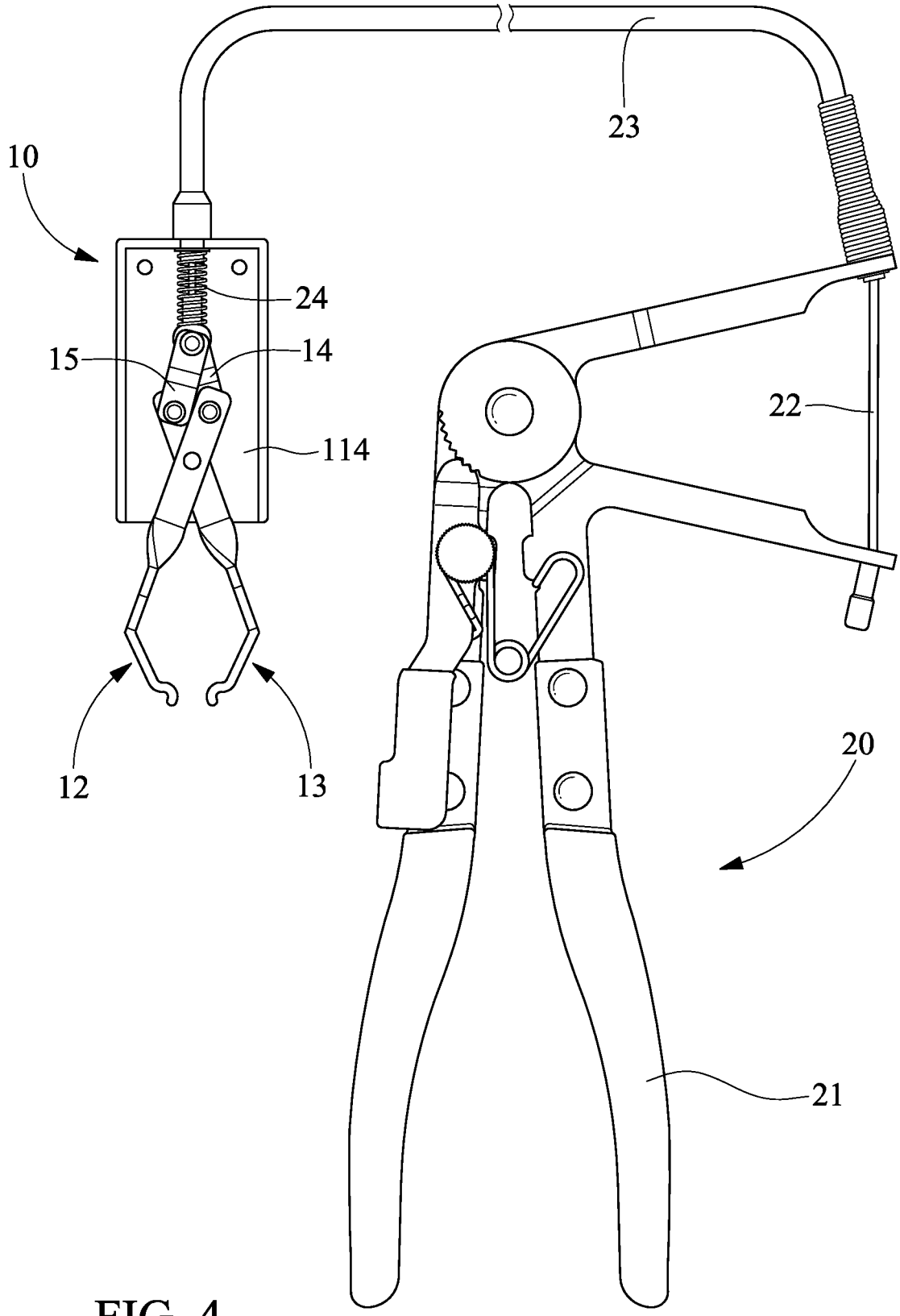
FIG. 4 is a side view of the joint-disconnecting tool shown in FIG. 1.
Figure 5:
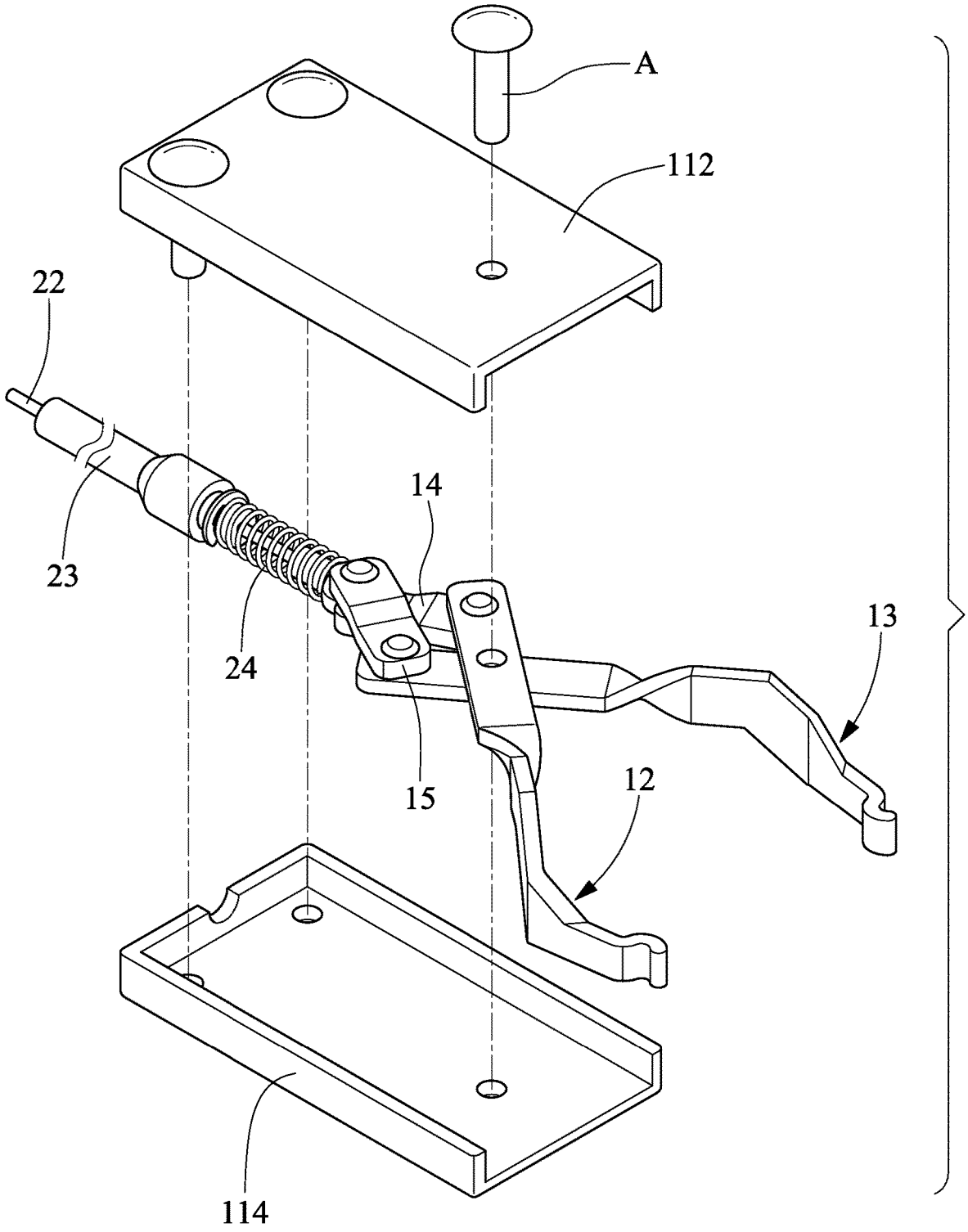
FIG. 5 is an exploded view of the clamp shown in FIG. 2.
Figure 6:
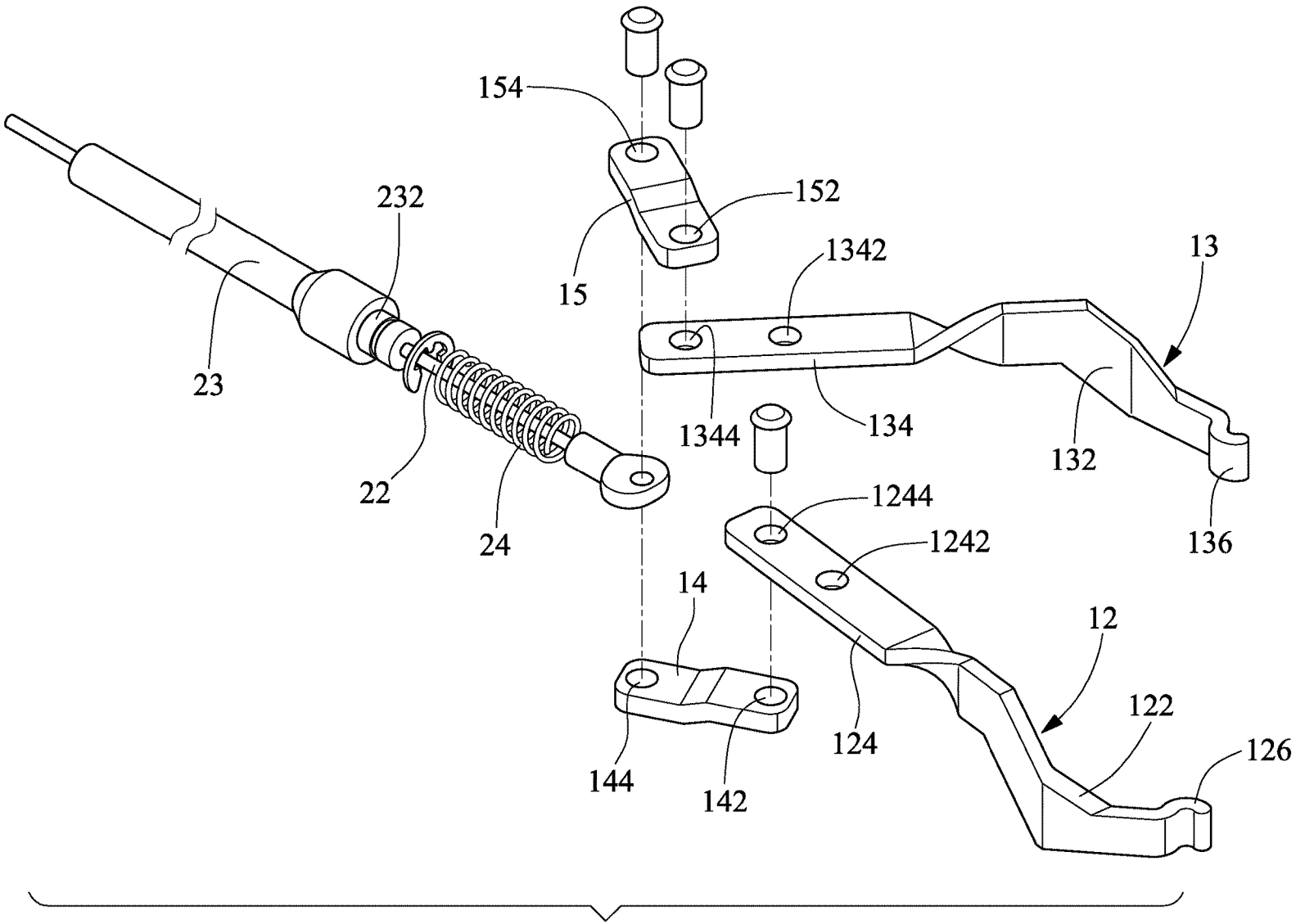
FIG. 6 is an exploded and partial view of the clamp shown in FIG. 5.

The case 11 includes a first shell 112 and a second shell 114. The first shell 112 is substantially identical to the second shell 114. The first shell 112 is connected to the second shell 114. The case 11 includes an opening 116 and an orifice 118 (FIGS. 2 and 3). The opening 116 and the orifice 118 are located at two opposite ends of the case 11.

The first branch 12 includes a first jaw 122 and a first lever 124 formed at two opposite ends. The first jaw 122 includes a contact portion 126. The first lever 124 includes two apertures 1242 and 1244.

The second branch 13 is formed with a second jaw 132 and a second lever 134 at two opposite ends. The second jaw 132 includes a contact portion 136. The second lever 134 includes two apertures 1342 and 1344.

A pin A is inserted in the apertures 1242 and 1342 to pivotally connect the first and second branches 12 and 13 to each other. The pin A is further inserted in apertures (not numbered) in the case 11 (the first and second shells 112 and 114) to pivotally connect the first and second branches 12 and 13 to the case 11. Each of the first and second branches 12 and 13 extends from the case 10 via the opening 116.

Each of the first and second branches 12 and 13 is substantially located out of the case 10 and is hence clearly visible.

The first linking element 14 includes a front aperture 142 and a rear aperture 144 at two opposite ends. Another pin A is inserted in the front aperture 142 of the first linking element 14 and the aperture 1244 of the first branch 12 to pivotally connect the first linking element 14 to the first branch 12.

The second linking element 15 includes a front aperture 152 與 a rear aperture 154 at two opposite ends. Another pin A is inserted in the front aperture 152 of the second linking element 15 and the second aperture 1344 of the second branch 13 to pivotally connect the second linking element 15 to the second branch 13.

Moreover, another pin A is inserted in the rear apertures 144 and 154 of the first and second linking elements 14 and 15 to pivotally connect the first and second linking elements 14 and 15 to each other.

The controller 20 includes a handles 21, a wire 22, a sheath 23 and a spring 24. The wire 22 includes a substantial section inserted in the sheath 23 and two ends located out of the sheath 23. The first end of the wire 22 is connected to and pulled by the handles 21. The second end of the wire 22 is connected to the pin that is inserted in the rear apertures 144 and 154 of the first and second linking elements 14 and 15. The spring 24 is inserted in the case 11. The spring 24 is compressed between the first and second linking elements 14 and 15 and an internal portion of the case 11 to push the first and second linking elements 14 and 15 from the internal portion of the case 11. Thus, the first and second jaws 122 and 132 of the first and second branches 12 and 13 are pushed away from each other because of the spring 24. The sheath 23 includes an end abutted against the handles 21 and another end formed with an annular groove 232 for receiving an edge that extends around the orifice 118. Thus, the sheath 23 is kept in position.

Figure 7:
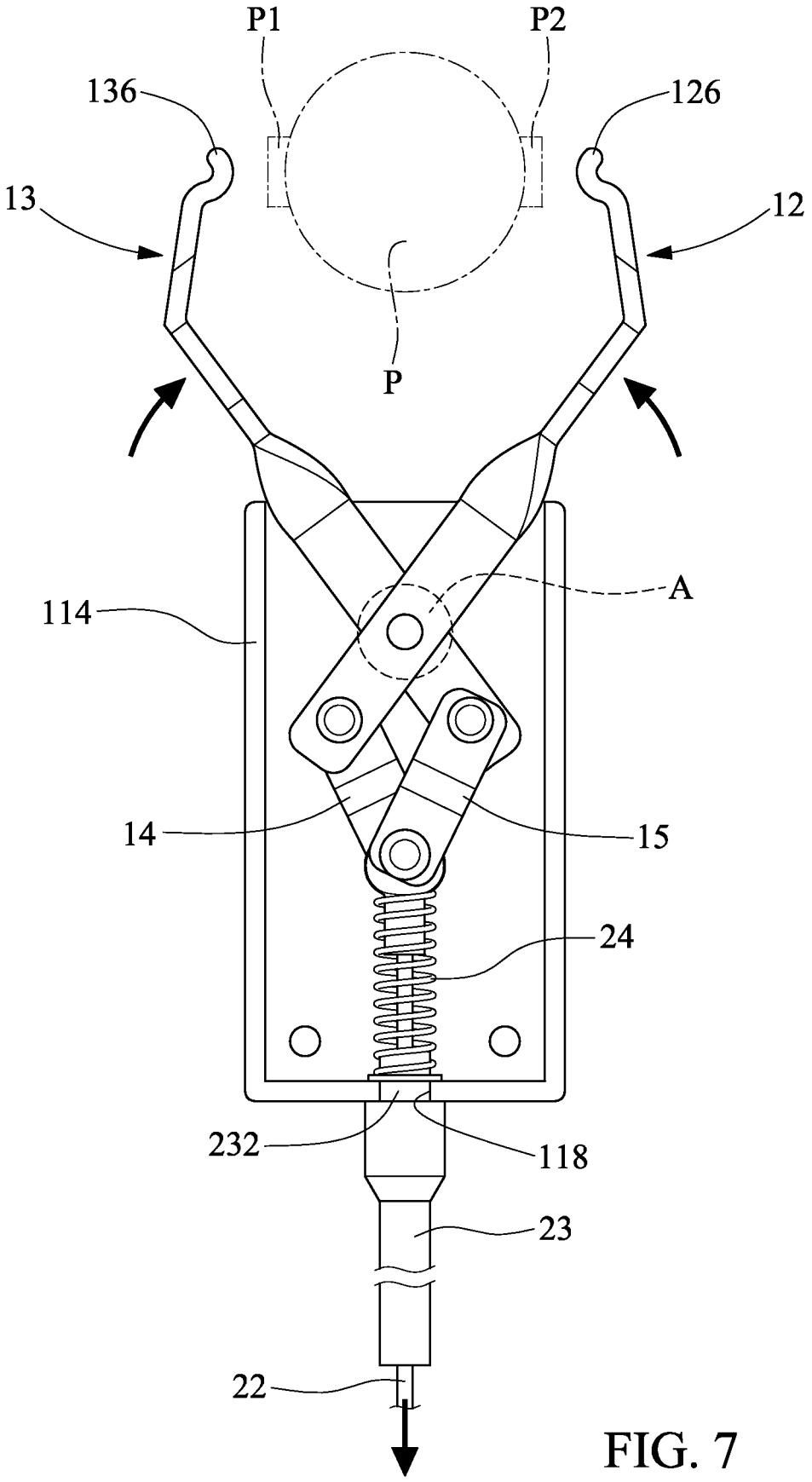
FIG. 7 is a cross-sectional view of the clamp shown in FIG. 2.
Figure 8:
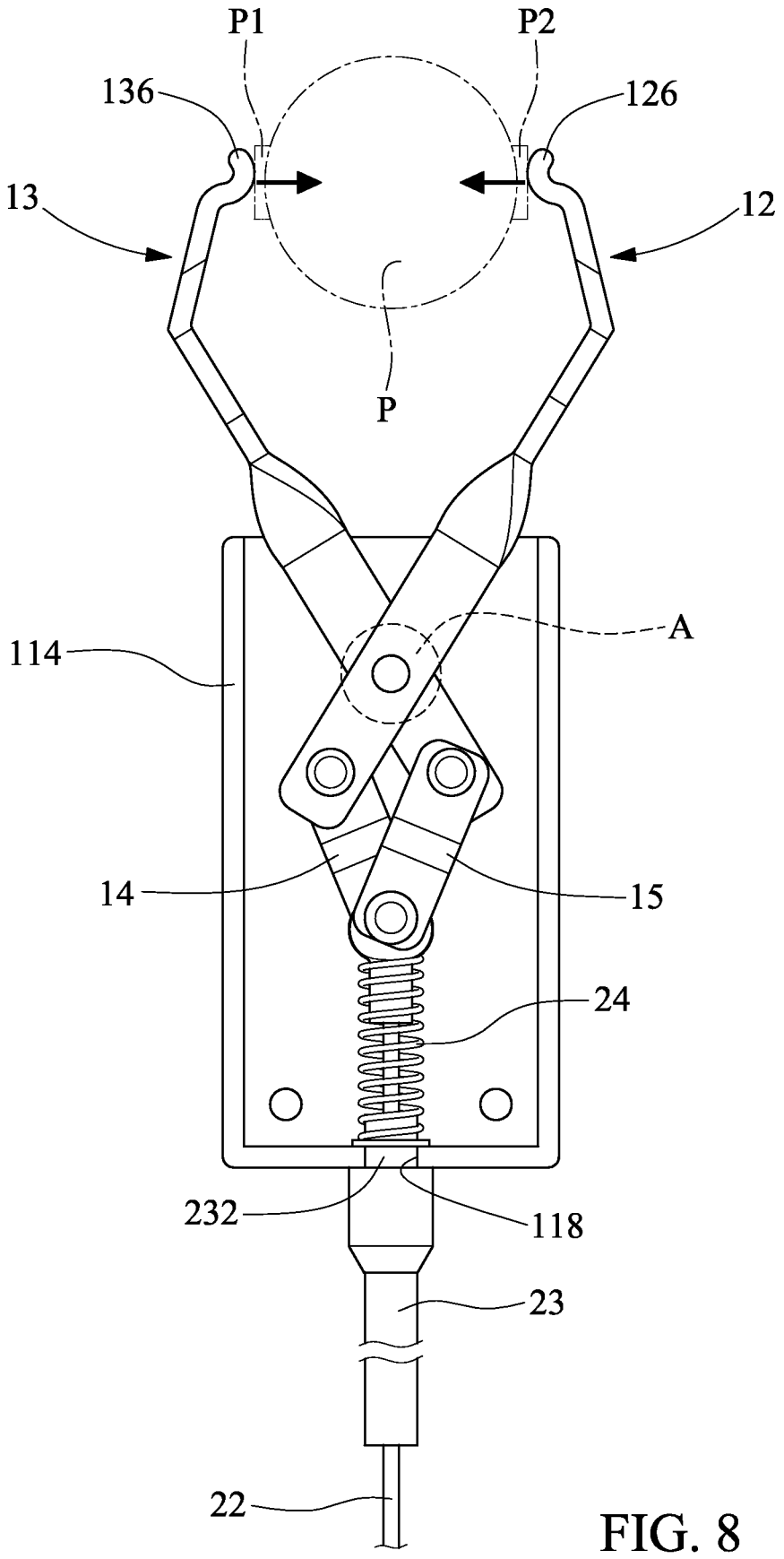
FIG. 8 is a cross-sectional view of the clamp in another position than shown in FIG. 7.

Referring to FIGS. 1 to 8, the contact portions 126 and 136 of the first and second jaws 122 and 132 of the first and second branches 12 and 13 of the clamp 10 are aligned to two elastic barbs P1 and P2 of a joint P (FIGS. 7 and 8). The elastic barbs P1 and P2 are substantially identical to the elastic barbs 112 of the insert 11 of the joint 1 disclosed in the RELATED PRIOR ART. Then, the handles 21 of the controller 20 are squeezed to use the wire 22 to pull the first and second linking elements 14 and 15 to further compress the spring 24. In turn, the first and second linking elements 14 and 15 pull and move the first and second levers 124 and 134 of the first and second branches 12 and 13 toward each other. Thus, the first and second branches 12 and 13 are pivoted about the pin A. Hence, the contact portions 126 and 136 of the first and second jaws 122 and 132 of the first and second branches 12 and 13 are moved toward each other, i.e., toward the elastic barbs P1 and P2 of the joint P.

On the contrary, the handles 21 of the controller 20 can be released to reduce the stress in the wire 22 of the controller 20. Thus, the spring 24 is allowed to move the first and second linking elements 14 and 15 back into the original position. Hence, the contact portions 126 and 136 of the first and second jaws 122 and 132 of the first and second branches 12 and 13 are moved away from each other.

The pin A is not movable relative to the case 11 so that the first and second jaws 122 and 132 are not moved into the case 11 when the first and second jaws 122 and 132 are moved toward each other. In fact, the first and second jaws 122 and 132 are moved just a little further from the case 11 when the first and second jaws 122 and 132 are moved toward each other. Therefore, it is easy to bring the contact portions 126 and 136 of the first and second jaws 122 and 132 into contact with the elastic barbs P1 and P2. Moreover, each of the first and second branches 12 and 13 does not include any portion that rubs against the case 11 in the operation. Hence, the first and second branches 12 and 13 are durable and reliable.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A joint-disconnecting tool comprising:

a clamp (10) comprising:

a case (11);

two branches (12, 13) each of which comprises a lever (124, 134) extending substantially in the case (11) and a jaw (122, 132) extending out of the case (11);

a first pin (A) for pivotally connecting the levers (124, 134) to the case (11), wherein the first pin (A) is not movable relative to the case (11); and two linking elements (14, 15) each of which comprises an end pivotally connected to one of the levers (124, 134) in the case (11); and a controller (20) comprising:

two handles (21) pivotally connected to each other;

a wire (22) comprising an end connected to one of the handles (21) and another end connected to another end of each of the linking elements (14, 15);

a sheath (23) wrapping the wire (22) except for the ends of the wire (22), wherein the sheath (23) comprises an end abutted against another one of the handles (21) and another end abutted against the case (11); and a spring (24) tending to push the linking elements (14, 15) from an internal portion of the case (11).

2. The joint-disconnecting tool according to claim 1, wherein the case (11) comprises an opening (116) and an orifice (118), wherein the jaws (122, 132) extend out of the case (11) via the opening (16), wherein the wire (22) extends into the case (11) through the orifice (118).

3. The joint-disconnecting tool according to claim 2, wherein the sheath (23) comprises an annular groove (232) for receiving an edge that extends around the orifice (118).

4. The joint-disconnecting tool according to claim 1, wherein each of the levers (124, 134) comprises a first aperture (1242, 1342) and a second aperture (1244, 1344), wherein the pin (A) is inserted in the first apertures (1242, 1342) of the levers (124, 134).

5. The joint-disconnecting tool according to claim 4, wherein each of the linking elements (14, 15) comprises a front aperture (142, 152) and a rear aperture (144, 154), wherein a pin (A) is inserted in the front aperture (142, 154) of each of the second linking elements (14, 15) and the second aperture (1244, 1344) of a corresponding one of the levers (124, 134), wherein a pin (A) is inserted in the rear apertures (144, 154) of the linking elements (14, 15).

* * * * *